US008127449B2

(12) United States Patent
Bayer et al.

(10) Patent No.: US 8,127,449 B2
(45) Date of Patent: Mar. 6, 2012

(54) PRESS-HARDENED COMPONENT AND METHOD FOR THE PRODUCTION OF A PRESS-HARDENED COMPONENT

(75) Inventors: Michael Bayer, Herrenberg (DE); Martin Brodt, Weil der Stadt (DE); Leonid Levinski, Brussels (BE); Victor Samoilov, Moscow (RU)

(73) Assignee: Z.A.T. Zinc Anticorosion Technologies SA, Fribourg (CH)

( * ) Notice: Subject to any disclaimer, the term of this patent is extended or adjusted under 35 U.S.C. 154(b) by 1311 days.

(21) Appl. No.: 10/565,037

(22) PCT Filed: Jul. 20, 2004

(86) PCT No.: PCT/EP2004/080870

§ 371 (c)(1),
(2), (4) Date: May 31, 2006

(87) PCT Pub. No.: WO2005/009642

PCT Pub. Date: Feb. 3, 2005

(65) Prior Publication Data

US 2007/0175040 A1 Aug. 2, 2007

(30) Foreign Application Priority Data

Jul. 22, 2003 (DE) ..... 103 33 166

(51) Int. Cl.

| | |
|---|---|
| ***B23P 25/00*** | (2006.01) |
| ***B21D 53/88*** | (2006.01) |
| ***C21D 7/02*** | (2006.01) |
| ***C21D 8/02*** | (2006.01) |

(52) U.S. Cl. ..... 29/897.2; 29/458; 29/460; 148/650; 428/543; 72/47; 72/338; 72/339

(58) Field of Classification Search ..... 29/897.2, 29/458, 460, 527.2; 148/602, 604, 567, 650; 72/47, 338, 339, 379.2; 427/405, 406; 428/543
See application file for complete search history.

(56) References Cited

U.S. PATENT DOCUMENTS

| | | | | |
|---|---|---|---|---|
| 6,524,725 | B1 * | 2/2003 | Lips et al. | 428/633 |
| 6,703,135 | B1 * | 3/2004 | Dietz et al. | 428/469 |
| 6,878,220 | B2 | 4/2005 | Gehringhoff et al. | 148/654 |
| 6,896,970 | B2 * | 5/2005 | Mayzel | 428/458 |
| 7,137,201 | B2 * | 11/2006 | Brodt et al. | 29/897.2 |
| 2002/0069506 | A1 | 6/2002 | Brodt et al. | 29/505 |

FOREIGN PATENT DOCUMENTS

| | | |
|---|---|---|
| DE | 43 07 563 | 9/1993 |
| DE | 100 49 660 | 4/2002 |
| DE | 101 35 647 | 7/2002 |
| DE | 101 49 221 | 8/2002 |
| WO | WO 2004/033126 | 4/2004 |

* cited by examiner

*Primary Examiner* — Jermie Cozart
(74) *Attorney, Agent, or Firm* — Norman B. Thot

(57) ABSTRACT

A method for the production of press-hardened components, in particular a vehicle body component, from a semifinished product (2) made of unhardened, hot-workable steel sheet. A component blank (10) is formed from the semifinished product (2), pre-coated with a first coating (33), by a cold-forming method, in particular a drawing method. The component blank (10) is trimmed at the margins to a marginal contour (12') approximately corresponding to the component (1) to be produced. The trimmed component blank (17) is heated and press-hardened in a hot-forming tool (23); then the press-hardened component blank (18) is covered with a second, anticorrosion coating (34) in a coating step.

21 Claims, 4 Drawing Sheets

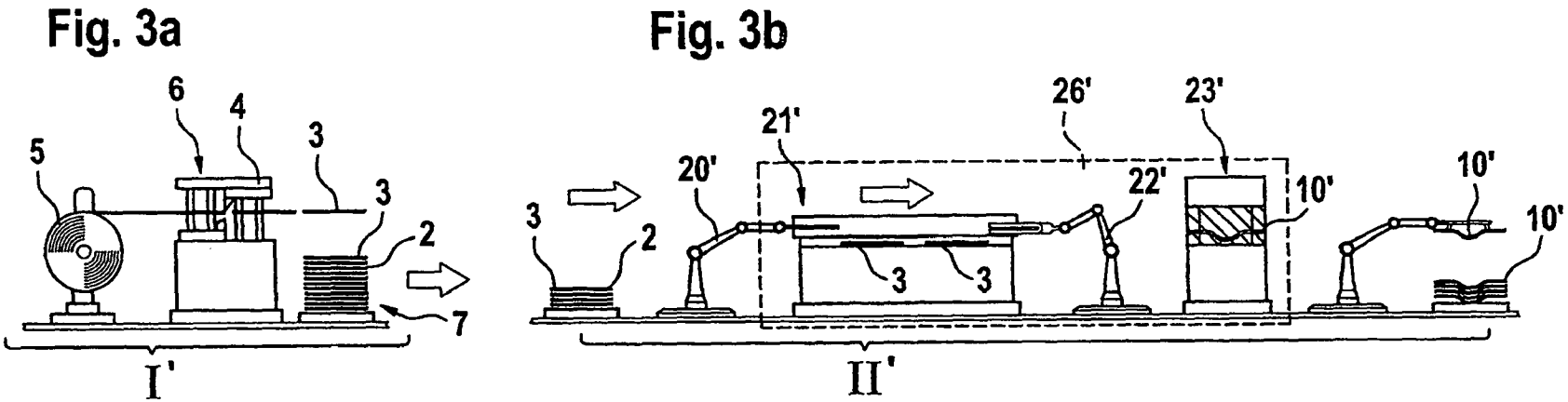
Fig. 3a
Fig. 3b
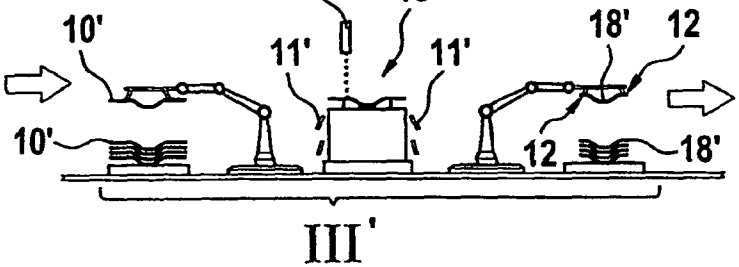
Fig. 3c
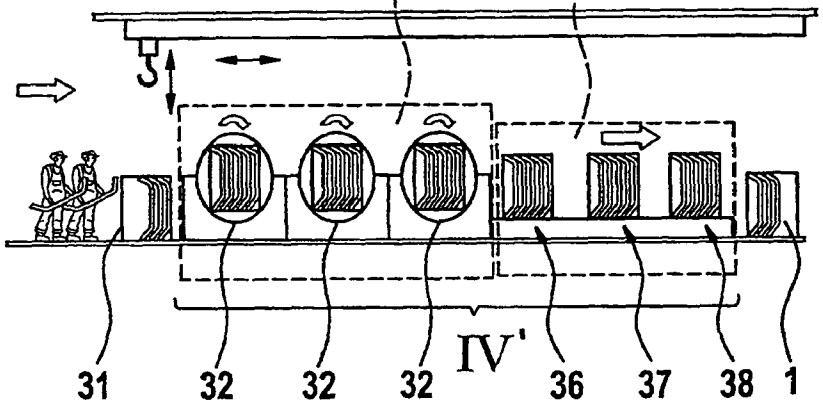
Fig. 3d

PRESS-HARDENED COMPONENT AND METHOD FOR THE PRODUCTION OF A PRESS-HARDENED COMPONENT

The invention relates to a press-hardened component and to a method for the production of a press-hardened component in particular a vehicle body component, from a semifinished product made of unhardened, hot-workable steel sheet.

BACKGROUND

In vehicle construction, stringent requirements are being increasingly imposed on the strength and rigidity of body parts. At the same time, however, in the interest of minimizing weight, a reduction in the material thickness is aimed at. High-strength and super-high-strength materials offer a solution in order to meet the conflicting requirements, these materials permitting the production of components of very high strength with at the same time a small material thickness. By a suitable selection of process parameters during conventional hot forming in the case of these materials, strength and toughness values of the component can be specifically set.

Such a material is, for example, the pre-coated boron steel sold by Usinor under the trade name Usibor 1500. The steel is provided with an AlSi coating, which, inter alia, exhibits advantageous corrosion-inhibiting properties in the course of the subsequent heat treatment.

To produce such a component by means of hot forming, first of all a sheet blank is cut out of a coil, this sheet blank is then heated above the structural transformation temperature of the steel materials, above which the material structure is in the austenitic state, is inserted in the heated state into a forming tool and is formed into the desired component shape and is cooled down while the desired forming state is mechanically fixed, tempering or hardening of the component being effected.

The component is often subjected to a pre-forming step or a trimming step before the actual hot forming. This is described, for example, in DE 101 49 221 C1. However, such a method may result in problems with regard to corrosion, since coil coating normally applied is damaged during the pre-forming. Conventional pre-forming and trimming of the components, especially in the case of pre-coated high-strength steels such as Usibor 1500 PC, which has an AlSi coating, is therefore omitted.

SUMMARY OF THE INVENTION

An object of the invention is to specify a press-hardened component and a production method for press-hardened components which permits reliable corrosion protection for pre-coated, hot-workable steels.

A first embodiment of the method according to the invention for producing press-hardened components comprises the following method steps: a component blank is formed from the semifinished product by a cold-forming method, in particular a drawing method; the component blank is trimmed at the margins to a marginal contour approximately corresponding to the component to be produced; the trimmed component blank is heated and press-hardened in a hot-forming tool; the press-hardened component blank is covered with an anticorrosion coating in a coating step.

This configuration of the invention firstly enables the component production process to be designed in such a way that the final trimming of the hardened component can be dispensed with, this trimming being complicated and costly in terms of the process. The marginal regions are therefore already cut off in the unhardened state of the component, not until after the heating and hardening process, as is conventional practice during the hot forming. By the workpiece already being trimmed in the soft state, substantially lower cutting forces are required than for the cold cutting of hardened materials, which leads to reduced material wear and to a reduction in the maintenance costs of the cutting tools. Furthermore, during the trimming of the high-strength material in the unhardened state, the risk of rapid crack formation on account of the high notch sensitivity of these materials is considerably reduced.

The pre-coating provided on the semifinished product avoids scaling of the trimmed component blank during the hardening process, and the requirements for an inert atmosphere during the hardening can be reduced. In addition, the pre-coating prevents decarburization of the material during the hardening. According to the invention, a further anticorrosion coating is applied after the hardening process, so that the component is completely coated, that is to say at the edges too.

In a further embodiment of the method according to the invention for the production of press-hardened components, the following method steps are carried out: the semifinished product pre-coated with a first coating is heated and press-hardened in a hot-forming tool; the component blank press-hardened in this way is trimmed at the margin to a marginal contour corresponding to the component to be produced; the press-hardened, trimmed component blank is covered with a second, anticorrosion coating in a coating step.

In this embodiment, the hardened component is preferably trimmed by means of a laser cutting process or the water-jet cutting process, thereby enabling high-quality trimming of the component edges to be achieved. The subsequent application of the second anticorrosion coating ensures that the component is also protected against corrosion in the region of the trimmed margins.

If the coating is applied to the press-hardened blank by a hot galvanizing process, an anticorrosion coating of zinc can be applied by a coating process which can be suitably integrated in a production process.

If the coating is applied to the press-hardened component blank by a thermal diffusion process, a readily controllable process can be used with which a coating of zinc or a zinc alloy can be applied, this process also being suitable for complex component geometries and for edge coating. The coating thickness can be specifically set between a few μm and over 100 μm. Thermal loading of the component is slight. Components can be coated irrespective of their size, the dimensions, configuration, complexity and weight. Cleaning before the coating step with dry cleaning, in particular blasting of the press-hardened component blank with glass particles or zinc particles, can be dispensed with, since the pre-coating essentially prevents scaling of the component blank during the hot forming. A process step is thereby saved; component distortion, which is certainly slight but possibly disturbing, caused by blasting the components with particles is additionally avoided.

During pre-coating with an aluminum-containing coating, preferably of AlSi, and zinc-containing coating, good adhesion between the two coatings is obtained. In addition, good protection of the material against hydrogen embrittlement is obtained, zinc in particular being able to protect the material against this hydrogen embrittlement. The second coating, which is applied to the first coating of the pre-coating, provides for edge coating and for coating of those regions in which the first coating of the pre-coating, e.g. during the pre-forming, has flaked or has become cracked due to excessive rubbing.

If the coated component blank is freed of residues of the coating step after the coating step, for example if it is passivated by ultrasound, a surface is formed which produces a good adhesion base for coatings, in particular primers for paints, or for paint itself.

The coated component blank is advantageously tempered after the coating step. It is especially advantageous if the component blank is coated with a zinc-containing coating, since an oxide which is suitable as an adhesive base is formed on the surface.

A press-hardened component according to the invention, in particular a vehicle body component, consisting of a semifinished product made of unhardened, hot-workable steel sheet is produced according to at least one of the developments of the method according to the invention. Such a component can be produced in an especially suitable manner in large quantities in large-scale production and combines an advantageous reduction in the weight of the component with excellent corrosion protection.

Further advantages and configurations of the invention can be gathered from the further claims and the description.

BRIEF DESCRIPTION OF THE DRAWINGS

The invention is explained in more detail below with reference to an exemplary embodiment shown in a drawing, in which:

FIG. 3 shows an alternative method sequence for producing a press-hardened component, where 3*a*: cutting the sheet blank to size (step I'); 3*b*: hot forming (step II'); 3*c*: trimming the margins (step III'); 3*d*: coating (step IV').

DETAILED DESCRIPTION

FIGS. 1*a* to 1*e* schematically show a method according to the invention for producing a three-dimensionally shaped, press-hardened component 1 from a semifinished product 2. In the present exemplary embodiment, the semifinished product 2 used is a sheet blank 3 which is cut out of an unwound coil 5. Alternatively, the semifinished product 2 used may also be a composite sheet, as described, for example, in DE 100 49 660 A1, and which consists of a base sheet and at least one reinforcing sheet. Furthermore, the semifinished product 2 used may also be a tailored blank which consists of a plurality of welded-together sheets of different material thickness and/or different material constitution. Alternatively, the semifinished product 2 may be a three-dimensionally shaped sheet-metal part which is produced by any desired forming method and which is to be subjected to further forming and an increase in strength and/or rigidity by means of the method according to the invention.

The semifinished product 2 consists of an unhardened, hot-workable steel sheet. An especially preferred material is a boron tempering steel, e.g. Usibor 1500, Usibor 1500 P or Usibor 1500 PC, which are sold by Usibor under these trade names.

Figure 2A:
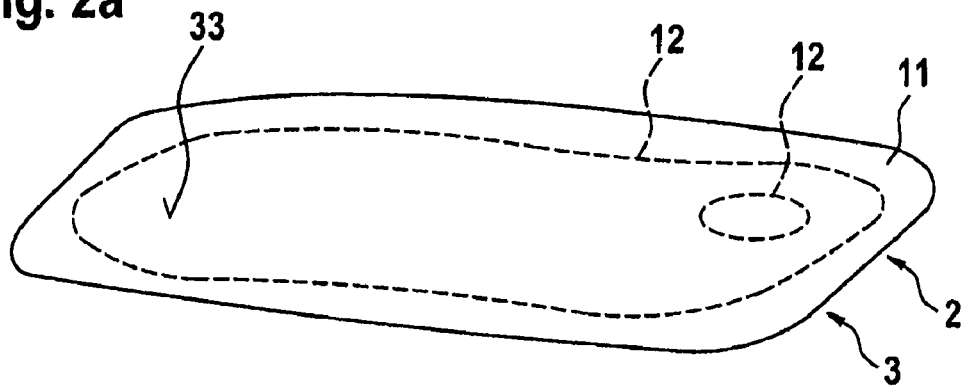
FIG. 2 shows perspective views of selected intermediate stages during the production of a component, where 2*a*: a pre-coated semifinished product; 2*b*: a component blank formed therefrom; 2*c*: a trimmed component blank; 2*d*: a coated component blank.

In a first process step I, the sheet blank 3 (FIG. 1*a*) is cut out of an unwound and straightened section of a coil 5 consisting of a pre-coated, hot-workable sheet. The coating is preferably a coating of aluminum or an aluminum alloy, in particular of an aluminum-silicon alloy AlSi. At this point, the hot-workable material is in an unhardened state, so that the sheet blank 3 can be cut out without any problems by means of conventional mechanical cutting means 4, e.g. reciprocating shears. In large-scale production use, the sheet blank 3 is advantageously cut to size by means of a blanking press 6, which ensures automated feeding of the coil 5 and automatic punching-out and discharge of the cut-out sheet blank 3. The sheet blank 3 cut out in this way is shown in FIG. 2*a* in a schematically perspective view.

Figure 1A:
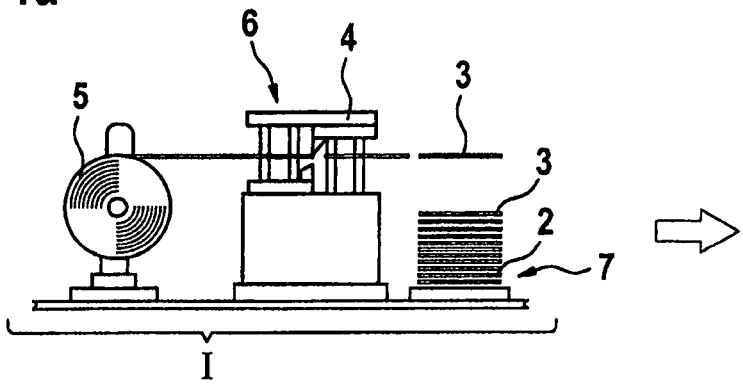
FIG. 1 shows a method scheme of the method according to the invention for producing a press-hardened component, where 1*a*: cutting the sheet blank to size (step I); 1*b*: cold forming (step II); 1*c*: trimming the margins (step III); 1*d*: hot forming (step IV); 1*e*: coating (step V); 1*f*: alternative coating method (step V')
Figure 1B:
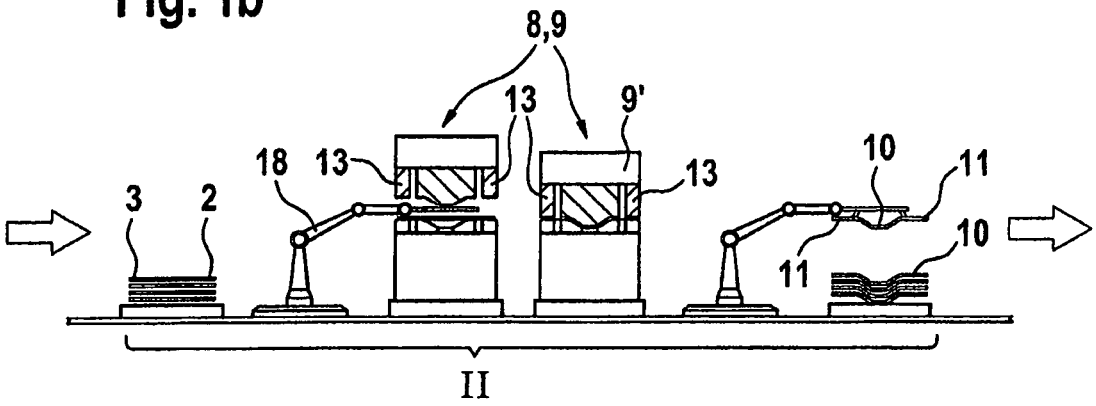
Figure 2B:
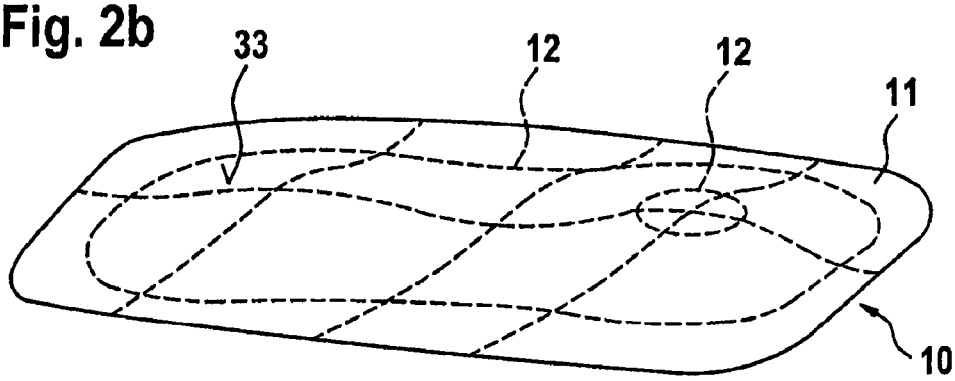

The cut-out sheet blanks 3 are deposited on a stack 7 and are fed in stacked form to a cold-forming station 8 (FIG. 1*b*). Here, in a second process step II, a component blank 10 is formed from the sheet blank 3 by means of the cold-forming tool 8, for example a two-stage deep-drawing tool 9. In order to be able to ensure high-quality shaping of the component geometry, the sheet blank 3 has marginal regions 11 which project beyond an outer contour 12 of the component 1 to be formed. In the course of this cold-forming process (process step II), the component blank 10 is shaped to near net shape. In this case, "near net shape" refers to the fact that those portions of the geometry of the finished component 1 which are accompanied by a macroscopic material flow are completely formed in the component blank 10 after completion of the cold-forming process. After completion of the cold-forming process, only slight adaptations of shape, which require minimum (local) material flow, are therefore necessary for producing the three-dimensional shape of the component 1; the component blank 10 is shown in FIG. 2*b*.

Depending on the complexity of the component 1, the shaping to near net shape may be effected in a single deep-drawing step, or it may be effected in a plurality of stages (FIG. 1*b*). Following the cold-forming process, the component blank 10 is inserted into a cutting device 15 and trimmed there (process step III, FIG. 1*c*). The material at this point is still in the unhardened state; therefore the trimming may be effected by conventional mechanical cutting means 14, such as, for instance, cutting blades, edging and/or punching tools.

Figure 1C:
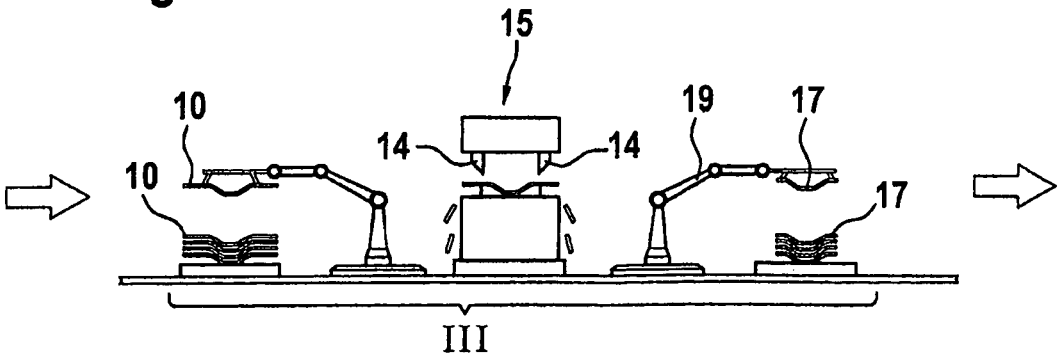
Figure 1D:
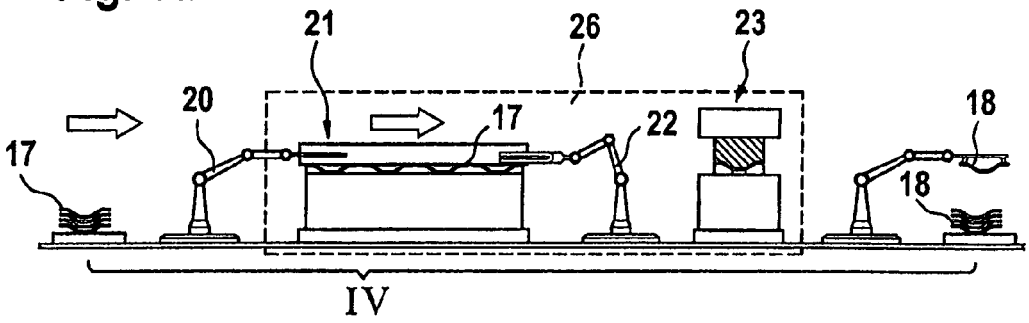
Figure 1E:
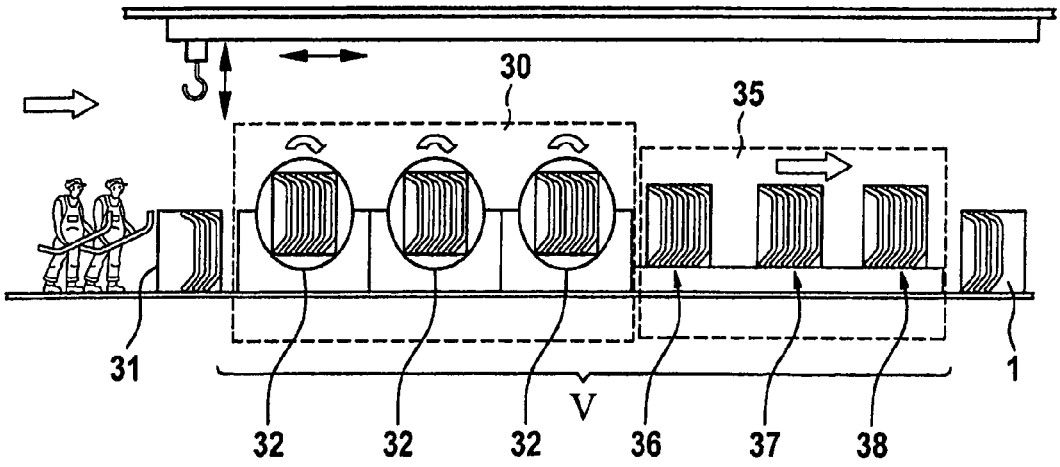

A separate cutting device 15, as shown in FIG. 1*c*, may be provided for the trimming. Alternatively, the cutting means 14 may be integrated in the last stage 9' of the deep-drawing tool 9, so that, in addition to the finish shaping of the component blank 10, the margin trimming may also be effected in the last deep-drawing stage 9'.

Figure 2C:
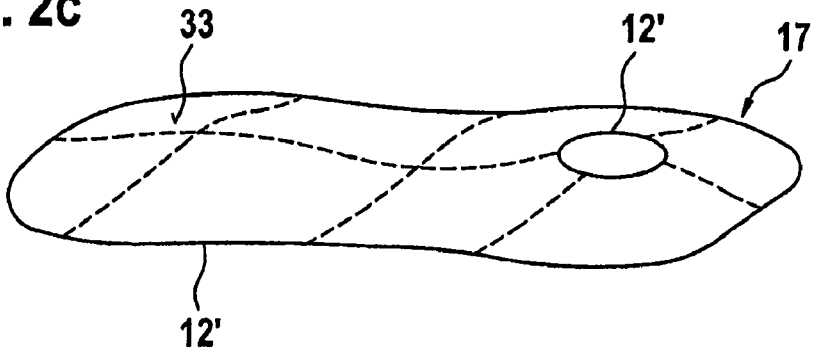
Figure 2D:
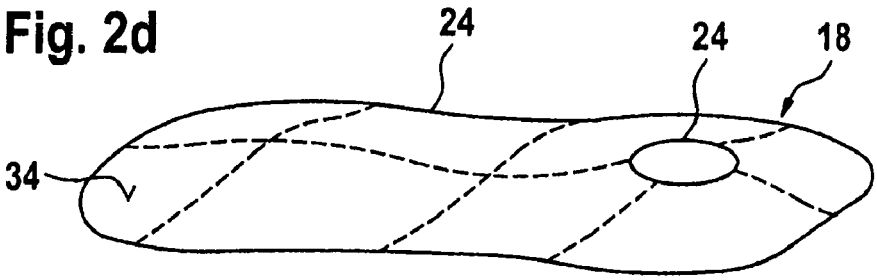

A near-net-shape trimmed component blank 17 is produced from the sheet blank 3 by the cold-forming process and the trimming (process steps II and III), this trimmed component blank 17, with regard to both its three-dimensional shape and its marginal contour 12', deviating only slightly from the desired shape of the component 1. The cut-off marginal regions 11 are discharged in the cutting device 15; the component blank 17 (FIG. 2*c*) is removed from the cutting device 15 by means of a manipulator 19 and fed to the next process step IV.

In an especially advantageous alternative, the process steps II and III are integrated in a single processing station, in which the shaping and cutting are carried out in a fully automatic manner. The component blank 17 may be removed from the processing station in an automated manner, or the component blanks 17 may be removed and stacked manually.

In the following process step IV (FIG. 1*d*), the trimmed component blank 17 is subjected to hot forming in a hot-forming region 26, in the course of which it is shaped to the final shape of the component 1 and hardened. The trimmed component blank 17 is inserted by means of a manipulator 20 into a continuous furnace 21, where it is heated to a temperature which is above the structural transformation temperature in the austenitic state; depending on the type of steel, this corresponds to heating to a temperature of between 700° C. and 1100° C. For a preferred material of a boron steel, in particular Usibor 1500P, a favorable range is between 900° C. and 1000° C. The atmosphere of the continuous furnace can be rendered inert by the addition of an inert gas; however, the pre-coating of the sheet blank 3 already prevents at least scaling over the full surface area of the sheet blank.

The uncoated intersections of the marginal contour 12' of the trimmed component blanks 17 represent only a very small proportion of the area of component blank 17, so that adhesion of a subsequently applied coating is virtually unaffected. A suitable inert gas for rendering the atmosphere inert is, for example, carbon dioxide or nitrogen.

The heated trimmed component blank 17 is then inserted by means of a manipulator 22 into a hot-forming tool 23, in which the three-dimensional form and the marginal contour 12' of the trimmed component blank 17 are given their desired size. Since the trimmed component blank 17 already has dimensions near net shape, only a slight adaptation of shape is necessary during the hot forming. In the hot-forming tool 23, the trimmed component blank 17 is finish-shaped and rapidly cooled, as a result of which a fine-grained martensitic or bainitic material structure is set. This step corresponds to hardening of the component blank 18 and permits specific setting of the material strength. Details of such a hardening process are described, for example, in DE 100 49 660 A1. Both the entire component blank 17 and locally selected points of the component blank 17 may be subjected to hardening. If the desired degree of hardening of the component blank 18 has been achieved, the hardened component blank 18 is removed from the hot-forming tool 23 by means of a manipulator and if necessary is stacked until further processing. Due to the fact that the component blank 10 is trimmed to near net shape preceding the hot-forming process and on account of the adaptation of shape of the marginal contour 12' in the hot-forming tool 23, the component 18 already has the desired outer contour 24 of the finished component 1 after completion of the hot-forming process, so that no time-consuming trimming of the component margin is necessary after the hot forming.

In order to achieve rapid quenching of the component blank 18 in the course of the hot forming, the component blank 18 may be quenched in a cooled hot-forming tool 23. Since the coating 33 of the pre-coating prevents scaling of the surface, subsequent cleaning may be dispensed with.

Since no laser cutting of the hardened component blank 18 has to be effected, the cycle times in the production method are advantageously short. In the method sequence, the cooling of the component blank 18 is now a possible bottleneck. In order to mitigate the latter, air-hardened or water-hardened materials may be used for the components 1. The component blank 18 then only needs to be cooled down until sufficient thermal stability, rigidity and associated dimensional accuracy of the component blank 18 are achieved. The component blank 18 can then be removed from the tool 23, so that the further heat-treatment process is effected in the air or in the water outside the tool 23, which is then available again very quickly after a few seconds for receiving further component blanks 17.

In a further process step V (FIG. 1*e*), the press-hardened component blank 18 is covered in a coating process with a coating 34 preventing corrosion of the component 1. To this end, drums 31 are charged with the press-hardened component blanks 18 and a zinc-containing powder, preferably a zinc alloy or a zinc mixture, are closed and are inserted into a coating unit 30. The component blanks 18 are slowly heated there to about 300° C. at about 5-10 K/min with the drums 31 slowly rotating. In this thermal diffusion process, the zinc or the zinc alloy is distributed essentially homogeneously over the entire surface of the component blanks 18 and combines with the surface. In the case of aluminum-containing pre-coating of the sheet blanks 3, excellent adhesion forms between the pre-coating, in particular AlSi, and the zinc-containing coating 34. At the same time, the uncoated cut edges are covered with the zinc-containing coating 34.

Depending on the composition of the powder, the time and the temperature, a uniform coating thickness appears on the component blanks 18, which coating thickness may be set as desired between a few μm and over 100 μm, preferably between 5 μm and 120 μm. The coating 34 is weldable and results in tensile strength which can amount to more than 1300 MPa for a component 1 of BTR 165. In the thermal diffusion process, virtually no residues or emissions into the environment occur.

The coating process is completed with a passivation operation in an adjoining passivation station 35, during which the drums 31 are discharged from the coating unit 30, are cooled in a cooling station 36, are freed of residues of the coating powder in a cleaning station 37 and are tempered in a tempering station 38 at a temperature of about 200° C. for about 1 h, in the course of which the coating 34 is passivated. If need be, suitable passivation additives may also be added. The finished, corrosion-protected components 1 may then be removed from the drums 31.

Figure 1F:
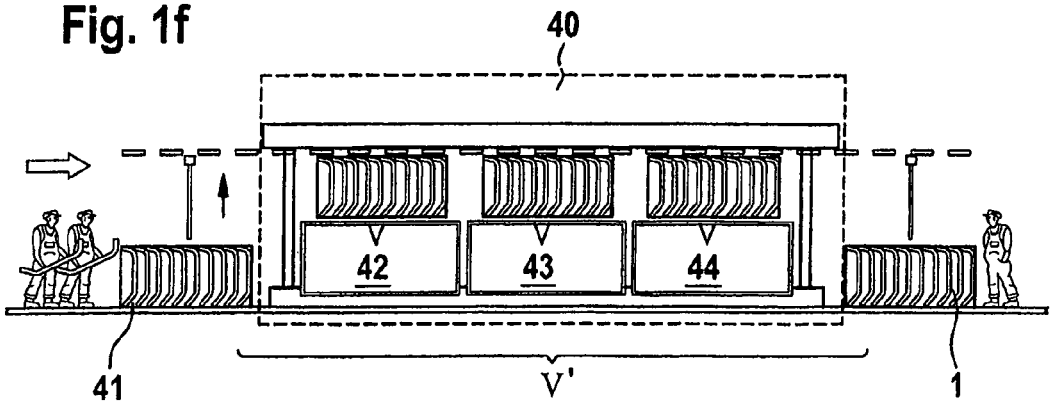

In an alternative configuration (process step V', FIG. 1*f*), the zinc-containing coating 34 is applied to the press-hardened component blank 18 in a coating region 40 by a hot galvanizing process. Component blanks 18 are suspended in a dip housing 41 which transports the component blanks 18 through a plurality of stations of the coating region 40. In a flux station 42, the component blanks 18 are suspended in a suitably temperature-regulated flux bath, preferably with zinc chloride, at about 360° C., are then dried in a drying station 43, preferably at 80° C., and are then dipped and galvanized in a galvanizing bath 44 at about 400-450° C. The finished components 1 can then be removed from the dip housing 31.

FIGS. 3*a* to 3*d* schematically show an alternative method sequence for producing a three-dimensionally shaped, press-hardened component 1 from a semifinished product 2, in particular from a pre-coated sheet blank 3. Here, too, in the same way as in the exemplary embodiment in FIGS. 1*a* to 1*e*, the sheet blank 3 is cut out of a pre-coated, hot-workable metal sheet in the blanking press 6 in a first process step (FIG. 3*a*). The coated sheet blank 3 is then subjected to a hot-forming step (FIG. 3*b*). To this end, the sheet blank 3 is inserted by means of a manipulator 20' into a continuous furnace 21', in which the sheet blank 3 is heated to a temperature which is above the transformation temperature in the austenitic state. The heated sheet blank 3 is then inserted into a hot-forming tool 23', in which a component blank 10' of the desired three-dimensional form is shaped from the sheet blank 3; in the process, the component blank 10' is cooled so rapidly that it is hardened (across the width of the component or locally). The continuous furnace 21' and the hot-forming tool 23' may be located in an inert-gas atmosphere 26'; however, the pre-coating of the sheet blanks 3 avoids scaling of the sheet blanks 3 over the entire surface.

The hardened component blank 10' is then transferred to a cutting device 15' (FIG. 3*c*), in which the component blank 10' is trimmed at the margin in order to produce a blank 18' with a marginal contour 12. The trimming is preferably effected with a laser 14'. The cut-off marginal regions 11' are disposed of. In the subsequent process step in FIG. 3*d*, the press-hardened and coated blank 18'—in a similar manner to the process steps V or V' in FIGS. 1*e* or 1*f*, respectively—is coated in a coating unit 30.

The press-hardened, coated component 1 is suitable in particular as a body component in vehicle construction, these body components being produced in large quantities. The method according to the invention permits advantageous process control with short cycle times; all the process steps have industrialization potential. Despite the use of a pre-coated material, it is possible to use conventional pre-forming. Due to the subsequent application of an additional anticorrosion coating, conventional forming and trimming become possible even in the case of high-strength materials, so that—when using the production method according to FIG. 1—laser cutting, which is expensive with large quantities, can be replaced in a cost-effective manner. By these production methods, sheet-metal components can already be validated in development by conventional forming simulation with regard to their production. There is also a favorable combination of the anticorrosion properties of the pre-coating 33 with those of the coating 34, with the advantage of the edge coating, in particular in the case of AlSi coatings 33 in combination with zinc coatings 34. In a vehicle which is assembled from such components, the fuel consumption is in turn reduced due to the reduction in the weight of the components, since the latter can be substantially thinner than conventional sheet-metal parts, whereas at the same time the passive safety is increased, since the components have very high strength.

What is claimed is:

1. A method for the production of a press-hardened component from a semifinished product made of unhardened, hot-workable steel sheet and precoated with a first coating, comprising the following method steps:

forming a component blank from the semifinished product by cold-forming;

trimming the component blank at a margin to a marginal contour approximately corresponding to the component to be produced;

heating and press-hardening the trimmed component blank in a hot-forming tool; and covering the press-hardened component blank with a second, anticorrosion coating.

2. The method as recited in claim 1 wherein the press-hardened component is a vehicle body component.

3. The method as recited in claim 1 wherein the cold forming includes drawing.

4. The method as recited in claim 1 wherein the second coating is applied to the press-hardened component blank by a hot galvanizing process.

5. The method as recited in claim 1 wherein the second coating is applied to the press-hardened component blank by a thermal diffusion process.

6. The method as recited in claim 1 wherein the second coating is deposited on both the first coating and uncoated regions of the component blank uncoated by the first coating.

7. The method as recited in claim 1 further comprising freeing the coated component blank coated by the second coating of residues of the covering step after the covering step.

8. The method as recited in claim 1 further comprising tempering the coated component blank after the covering step.

9. A method for the production of a press-hardened component from a semifinished product made of unhardened, hot-workable steel sheet and precoated with a first coating, comprising the following method steps:

heating and press-hardening the semifinished product in a hot-forming tool so as to define a component blank;

trimming the component blank at a margin to a marginal contour corresponding to the component to be produced;

covering the press-hardened component blank with a second, anticorrosion coating.

10. The method as recited in claim 9 wherein the press-hardened component is a vehicle body component.

11. The method as recited in claim 9 wherein the second coating is applied to the press-hardened component blank by a hot galvanizing process.

12. The method as recited in claim 9 wherein the second coating is applied to the press-hardened component blank by a thermal diffusion process.

13. The method as recited in claim 9 wherein the second coating is deposited on both the first coating and uncoated regions of the component blank uncoated by the first coating.

14. The method as recited in claim 9 further comprising freeing the coated component blank coated by the second coating of residues of the covering step after the covering step.

15. The method as recited in claim 9 further comprising tempering the coated component blank after the covering step.

16. A press-hardened component, the press-hardened component being produced by:

providing a semifinished product made of unhardened, hot-workable steel sheet and precoated with a first coating;

forming a component blank from the semifinished product by cold-forming;

trimming the component blank at a margin to a marginal contour approximately corresponding to the component to be produced;

heating and press-hardening the trimmed component blank in a hot-forming tool; and covering the first coating of the press-hardened component blank directly with a second, anticorrosion coating so as to obtain the press-hardened component.

17. The press-hardened component as recited in claim 16 wherein the first coating includes aluminum and the second, anticorrosion coating includes zinc.

18. A press-hardened component, the press-hardened component being produced by:

providing a semifinished product made of unhardened, hot-workable steel sheet and precoated with a first coating:

heating and press-hardening the semifinished product in a hot-forming tool so as to define a component blank;

trimming the component blank at a margin to a marginal contour corresponding to the component to be produced; and covering the first coating of the press-hardened component blank directly with a second, anticorrosion coating so as to obtain the press-hardened component.

19. The press-hardened component as recited in claim 18 wherein the first coating includes aluminum and the second, anticorrosion coating includes zinc.

20. A method for the production of a press-hardened component from a semifinished product made of unhardened, hot-workable steel sheet and precoated with a first coating comprising at least one of aluminum, an aluminum alloy and an aluminum-silicon alloy, comprising the following method steps:

forming a component blank from the semifinished product by cold-forming;

trimming the component blank at a margin to a marginal contour approximately corresponding to the component to be produced;

heating and press-hardening the trimmed component blank in a hot-forming tool; and covering the press-hardened component blank with a second, anticorrosion coating, wherein the covering is performed by at least one of a thermal diffusion with the second, anticorrosion coating comprising at least one of zinc and a zinc alloy, and a hot galvanizing with the second, anticorrosion coating comprising at least one of zinc, a zinc alloy and zinc chloride.

21. A method for the production of a press-hardened component from a semifinished product made of unhardened, hot-workable steel sheet and precoated with a first coating comprising at least one of aluminum, an aluminum alloy and an aluminum-silicon alloy, comprising the following method steps:

heating and press-hardening the semifinished product in a hot-forming tool so as to define a component blank;

trimming the component blank at a margin to a marginal contour corresponding to the component to be produced;

covering the press-hardened component blank with a second, anticorrosion coating, wherein the covering is performed by at least one of a thermal diffusion with the second, anticorrosion coating comprising at least one of zinc and a zinc alloy, and a hot galvanizing with the second, anticorrosion coating comprising at least one of zinc, a zinc alloy and zinc chloride.

* * * * *

US008127449C1

(12) EX PARTE REEXAMINATION CERTIFICATE (9812th)

United States Patent

Bayer et al.

(10) Number: US 8,127,449 C1

(45) Certificate Issued: Aug. 26, 2013

(54) PRESS-HARDENED COMPONENT AND METHOD FOR THE PRODUCTION OF A PRESS-HARDENED COMPONENT

(75) Inventors: Michael Bayer, Herrenberg (DE); Martin Brodt, Weil de Stadt (DE); Leonid Levinski, Brussels (BE); Victor Samoilov, Moscow (RU)

(73) Assignee: Z.A.T. Zinc Anticorosion Technologies SA, Pully (CH)

Reexamination Request:
No. 90/012,435, Oct. 12, 2012

Reexamination Certificate for:

| | |
|---|---|
| Patent No.: | **8,127,449** |
| Issued: | **Mar. 6, 2012** |
| Appl. No.: | **10/565,037** |
| Filed: | **May 31, 2006** |

(21) Appl. No.: 90/012,435

(22) PCT Filed: Jul. 20, 2004

(86) PCT No.: PCT/EP2004/080870

§ 371 (c)(1), (2), (4) Date: May 31, 2006

(87) PCT Pub. No.: WO2005/009642

PCT Pub. Date: Feb. 3, 2005

(30) Foreign Application Priority Data

Jul. 22, 2003 (DE) ..... 103 33 166

(51) Int. Cl.

| | |
|---|---|
| ***B23P 25/00*** | (2006.01) |
| ***B21D 53/88*** | (2006.01) |
| ***C21D 7/02*** | (2006.01) |
| ***C21D 8/02*** | (2006.01) |
| ***B21D 35/00*** | (2006.01) |
| ***C21D 1/673*** | (2006.01) |
| ***C23C 2/26*** | (2006.01) |
| *C21D 9/46* | (2006.01) |
| *C23C 10/60* | (2006.01) |

(52) U.S. Cl.

CPC ..... *B21D 35/00* (2013.01); *C21D 1/673* (2013.01); *C21D 9/46* (2013.01); *C23C 2/26* (2013.01); *C23C 10/60* (2013.01)

USPC ..... 29/897.2; 29/458; 29/460; 72/47; 72/338; 72/339; 148/650; 428/543

(58) Field of Classification Search

None

See application file for complete search history.

(56) References Cited

To view the complete listing of prior art documents cited during the proceeding for Reexamination Control Number 90/012,435, please refer to the USPTO's public Patent Application Information Retrieval (PAIR) system under the Display References tab.

*Primary Examiner* — Sean E Vincent

(57) ABSTRACT

A method for the production of press-hardened components, in particular a vehicle body component, from a semifinished product (2) made of unhardened, hot-workable steel sheet. A component blank (10) is formed from the semifinished product (2), pre-coated with a first coating (33), by a cold-forming method, in particular a drawing method. The component blank (10) is trimmed at the margins to a marginal contour (12') approximately corresponding to the component (1) to be produced. The trimmed component blank (17) is heated and press-hardened in a hot-forming tool (23); then the press-hardened component blank (18) is covered with a second, anticorrosion coating (34) in a coating step.

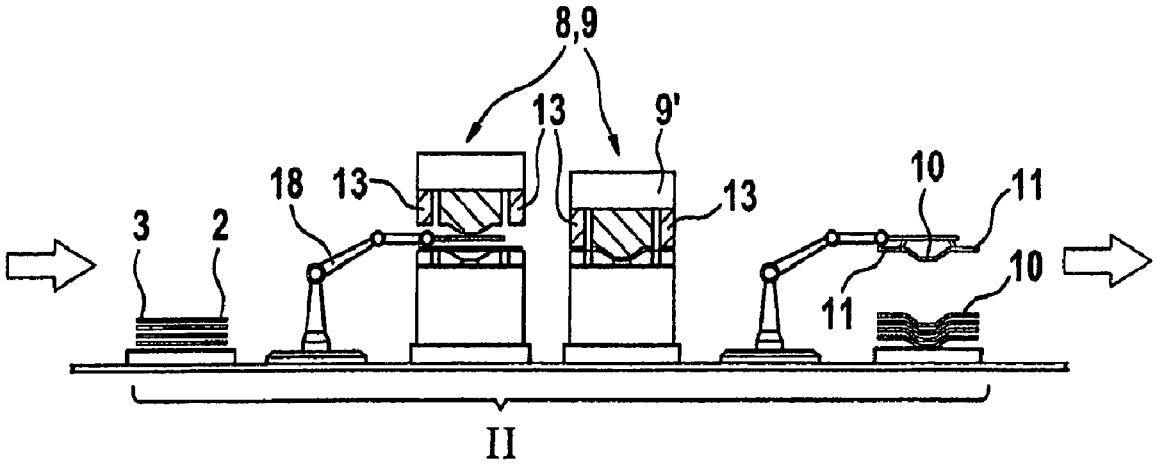

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1, 4 and 5 is confirmed.

Claims 11 and 12 are cancelled.

Claim 9 is determined to be patentable as amended.

Claims 2, 3, 6-8, 10 and 13-21 were not reexamined.

9. A method for the production of a press-hardened component from a semifinished product made of unhardened, hot-workable steel sheet and precoated with a first coating, comprising the following method steps:

heating and press-hardening the semifinished product in a hot-forming tool so as to define a component blank;

trimming the component blank at a margin to a marginal contour corresponding to the component to be produced;

covering the *trimmed and* press-hardened component blank with a second, anticorrosion coating *by a thermal diffusion process*.

* * * * *